US007306710B2

(12) United States Patent
Schepel et al.

(10) Patent No.: US 7,306,710 B2
(45) Date of Patent: Dec. 11, 2007

(54) APPARATUS AND METHOD FOR ELECTROPLATING A METALLIC FILM ON A ROCKET ENGINE COMBUSTION CHAMBER COMPONENT

(75) Inventors: Chad M. Schepel, Thousand Oaks, CA (US); Jeffry A. Fint, Granada Hills, CA (US); Steve J. Evans, Simi Valley, CA (US); Cecil E. Flowers, Palmdale, CA (US)

(73) Assignee: Pratt & Whitney Rocketdyne, Inc., Canoga Park, CA (US)

( * ) Notice: Subject to any disclaimer, the term of this patent is extended or adjusted under 35 U.S.C. 154(b) by 443 days.

(21) Appl. No.: 10/290,723

(22) Filed: Nov. 8, 2002

(65) Prior Publication Data

US 2004/0089554 A1 May 13, 2004

(51) Int. Cl.
*C25D 5/00* (2006.01)
*C25D 5/02* (2006.01)

(52) U.S. Cl. ..... 205/143; 205/134; 205/137

(58) Field of Classification Search ..... 205/134, 205/137, 143
See application file for complete search history.

(56) References Cited

U.S. PATENT DOCUMENTS

| | | | | |
|---|---|---|---|---|
| 3,647,646 | A * | 3/1972 | Tucker et al. | 205/143 |
| 3,930,962 | A | 1/1976 | Cook et al. | 204/13 |
| 4,187,154 | A * | 2/1980 | Dewallens | 205/68 |
| 4,304,641 | A | 12/1981 | Grandia et al. | 204/23 |
| 4,659,446 | A | 4/1987 | Shafer et al. | 204/212 |
| 5,879,520 | A | 3/1999 | Griego | 204/212 |
| 6,442,931 | B1 * | 9/2002 | Vasin et al. | 60/257 |
| 6,790,332 | B2 * | 9/2004 | Ewald et al. | 205/96 |

* cited by examiner

*Primary Examiner*—Edna Wong

(57) ABSTRACT

A tank is utilized for containing a plating solution. A rotatable support assembly rotatably supports a combustion chamber component relative to the tank for providing partial immersion of the combustion chamber component within the plating solution. An anode is positioned within the tank proximate a surface of the combustion chamber component to be electroplated. A current source is connected to the anode and in electrical contact with the combustion chamber component. When the combustion chamber component is rotated, the submerged portions are deposited with metal from the plating solution.

6 Claims, 2 Drawing Sheets

APPARATUS AND METHOD FOR ELECTROPLATING A METALLIC FILM ON A ROCKET ENGINE COMBUSTION CHAMBER COMPONENT

BACKGROUND OF THE INVENTION

1. Field of the Invention

The present invention relates to rocket engine combustion chamber fabrication and more particularly to the electrodeposition of metal alloys for the purposes of surface preparation.

2. Description of the Related Art

Large scale combustion chambers are often fabricated from alloys that are not conducive to the brazing operations required to build them. In situations such as this electrodeposited metal alloys are used to create a surface on which the brazing alloy will flow. The problem with electrodepositing alloy on large structures such as rocket engine combustion chambers is that a significant amount of current is required. The amount of current required is a function of the surface area in the plating solution. Currently one of two solutions to this problem exists. The first requires plating the part in sections and requires specialized cells to be fabricated and attached to the part. This is both labor intensive and time consuming. The second requires a large tank and current source to completely submerge and electroplate the part. A tank of this size requires specialized construction and results in a significant amount of plating solution waste. Special electrical wiring beyond that of standard high energy equipment is also required to supply the necessary amount of current.

U.S. Pat. No. 3,930,962, issued to G. M. Cook, et al, discloses a process and apparatus for producing thin copper foils by electroplating the copper onto a rotating drum serving as a cathode where the surface of the rotating drum is molybdenum or TZM alloy. The '962 patent does not address depositing coatings other than copper and also does not address deposits which require adherence to the cathode part.

U.S. Pat. No. 4,304,641, issued to J. Grandia, et al, discloses an apparatus and a method for rotary electroplating a thin metallic film. The apparatus includes a flow-through jet plate having nozzles of increasing size and uniformly spaced radially therethrough, or the same sized nozzles with varying radial spacing therethrough so as to provide a differential flow distribution of the plating solution that impinges on the wafer-cathode where the film is deposited. The spacing and size of the nozzles are critical to obtaining a uniform thickness. The electrical currents to the wafer and to the thieving ring are controlled by variable resistors so as to keep the electrical current to the cathode constant throughout the plating process. In a preferred embodiment the flow-through jet plate has an anode associated therewith in which the exposed area of the anode is maintained at a constant amount during the deposition. The method can simultaneously deposit with a uniform thickness and composition elements having a minimum gap or part size of 1 micrometer or less. U.S. Pat. No. 4,304,641 does not address the deposition of a metallic film on large parts with a conical geometry and is rather applied generally to the deposition on flat wafers with a desired film thickness on the order of micrometers.

U.S. Pat. No. 4,659,446 issued to D. A. Schafer, et al, discloses an apparatus for the electroplating printing cylinders or the like, cup-like shields of non-conductive acid-resistant material are secured at opposite ends of the cylinder for rotation with the cylinder, the shields extend radially outward and having a configuration such as to obtain a field distribution by which the metal deposited on the surface of the cylinder is of substantially uniform thickness and density throughout the length of the cylinder. U.S. Pat. No 4,659,446 does not address the electrodeposition of metal alloys on the typically conically shaped parts of rocket engine combustion chamber components as well as the deposition of metal alloys on the interior diameter of such components.

SUMMARY

The present invention is an apparatus and method for electroplating a metallic film on a rocket engine combustion chamber component. The invention utilizes a tank for containing a plating solution. A rotatable support assembly rotatably supports a combustion chamber component relative to the tank for providing partial immersion of the combustion chamber component within the plating solution. An anode is positioned within the tank proximate a surface of the combustion chamber component to be electroplated. A current source is connected to the anode and in electrical contact with the combustion chamber component. When the combustion chamber component is rotated, the submerged portions are deposited with metal from the plating solution.

The present invention offers significant advantages in the following manifestations: eliminates the need for current ranges in excess of those normally provided by typically standard industrial electrical supply; offers a reduction in the volume of typically hazardous plating solution waste; and, reduces the facility and equipment size and related expenditure required to complete the electrodeposition process on large rocket engine combustion chamber components.

Other objects, advantages, and novel features will become apparent from the following detailed description of the invention when considered in conjunction with the accompanying drawings.

BRIEF DESCRIPTION OF THE DRAWINGS

The same parts or elements throughout the drawings are designated by the same reference characters.

DETAILED DESCRIPTION OF THE INVENTION

Figure 1:
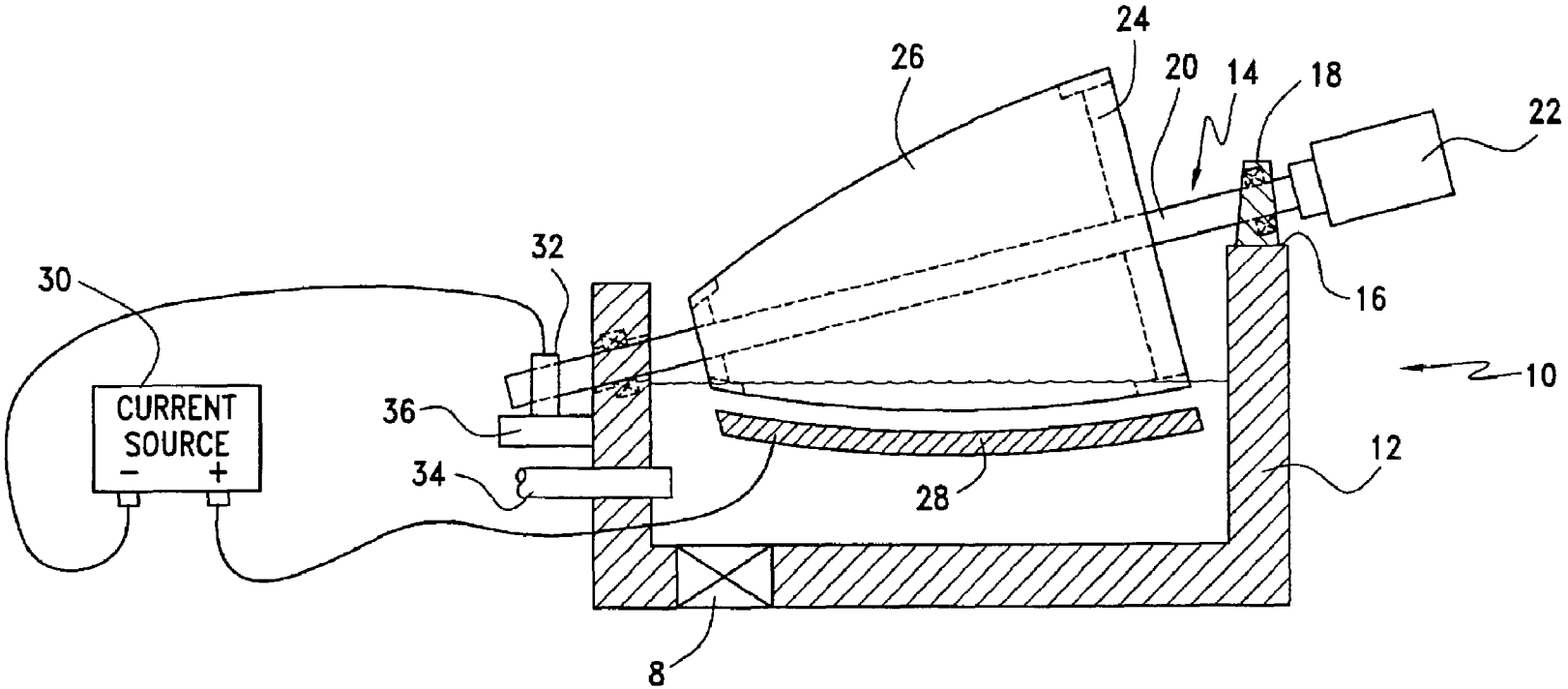
FIG. 1 is a schematic illustration, partially in cross section, of a first embodiment of the present invention in which the rocket engine combustion chamber is rotated off-axis such that the component surface is approximately normalized to the horizontal.

Referring now to the drawings and the characters of reference marked thereon, FIG. 1 illustrates a first preferred embodiment of the apparatus of the present invention, designated generally as 10. The apparatus 10 includes a tank 12 for containing a plating solution. The tank 12 may be, for example, constructed of a non-conductive acid-resistant material.

A rotatable support assembly, designated generally as 14, supports a combustion chamber component 26 relative to the tank 12. The rotatable support assembly 14 includes a support member 16 that might include, for example, a section of the tank 12 or a platform or support structure external to the tank. A bearing assembly 18 is supported by the support member 16. A rotatable shaft 20 is supported by the bearing assembly 18. A motor 22 provides the necessary rotation of the shaft 20.

A support structure 24 supports the combustion chamber component 26 on the rotatable shaft 20. This structure provides support to the combustion chamber component throughout its length and circumference.

The combustion chamber component 26 may be, for example, a liner for the combustion chamber, to be electroplated on the outside diameter of the part, as is shown in FIG. 1. Alternatively, it may be a combustion chamber jacket, to be electroplated on the inside diameter of the part. It is desirable to electroplate both of these combustion chamber components in order to achieve a proper Hot Isostatic Pressure (HIP) braze bond between each component's mating surfaces.

The rotatable support assembly 14 preferably rotates the combustion chamber component 26 'off axis', such as shown in FIG. 1, so that the surface of the combustion chamber component 26 to be electroplated is approximately parallel to the surface of the plating solution. This "off-axis" rotation is very efficient and minimizes the size of the tank and thus the amount of plating solution.

An anode 28 is positioned within the tank 12 proximate a surface of the combustion chamber component 26 to be electroplated. Anode configuration is dependent on the metal being deposited and geometry varies with the change in diameter of the combustion chamber component to effect a uniform thickness across the surface.

A current source 30 is connected to the anode 28 and is in electrical contact with the combustion chamber component 26. Current source 30 is typically direct current (DC) ranging from approximately 4 to 18 volts and current is dependent on the surface area in solution at an approximate current density of 20 amps per square foot.

An electric bushing 32 provides the electrical path between the current source 30 and the combustion chamber component 26.

During operation, the tank 12 is supplied with a suitable plating solution through an inlet 34. The tank 12 is filled to provide partial immersion of the combustion chamber component 26 within the plating solution such that the entire length of the part is in solution to a desirable depth. When the current source 30 is activated the combustion chamber component 26 serves as the cathode and the submerged portions of the component 26 are deposited with metal from the plating solution and anode. The combustion chamber component surface is immersed to the approximate range of 20-50% of its surface area. The preferred range is 25-30%.

The present invention has particular advantages where the combustion chambers components are large i.e. 6-9 feet exit diameters, 8-11 feet lengths. The particular application used by present applicants is surface preparation of the combustion chamber components, which have an exit diameter of eight feet and a length of ten feet, for brazing applications.

Figure 2:
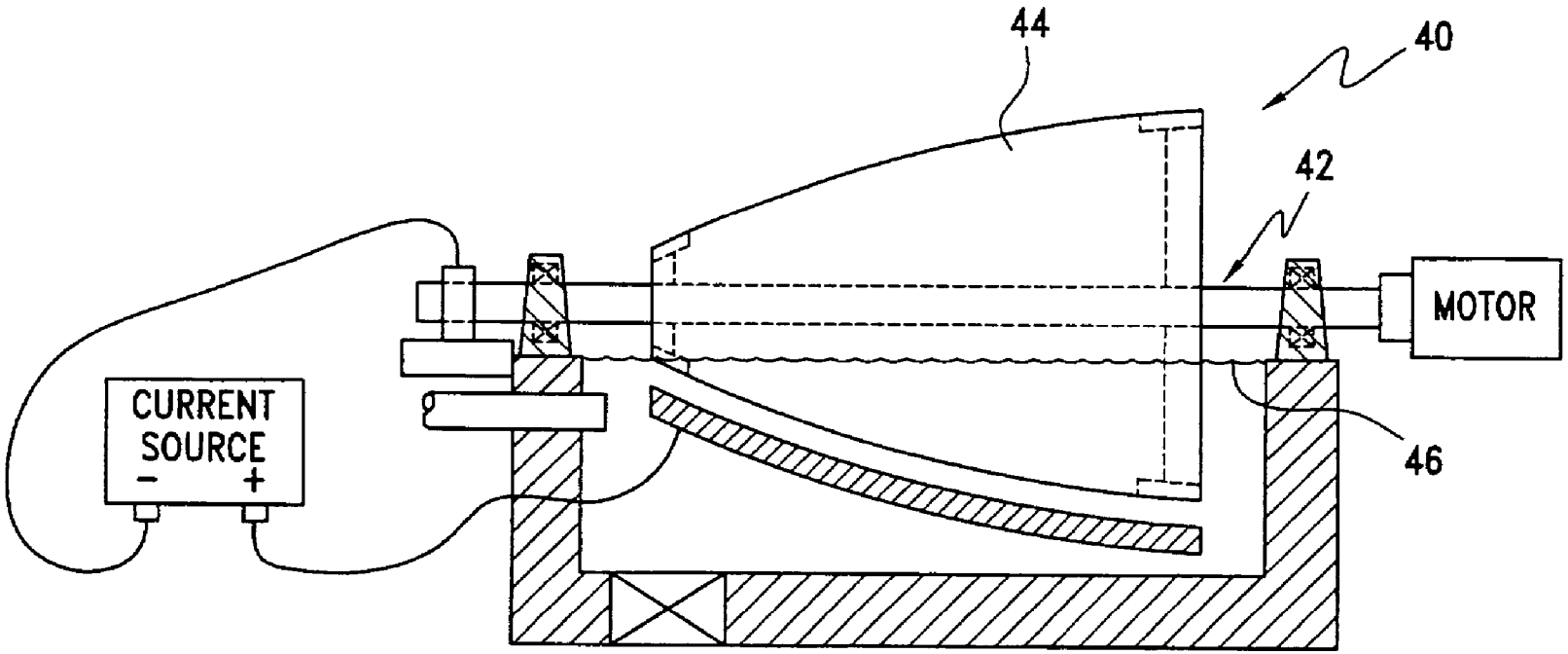
FIG. 2 is a schematic illustration, partially in cross section, of a second embodiment in which the rocket engine combustion chamber is rotated on-axis such that the component centerline is horizontal.

Referring now to FIG. 2 a second embodiment is illustrated, designated generally as 40, in which the rotatable support assembly rotates the combustion chamber component 44 'on axis', such that a central axis of the combustion chamber component 44 is approximately parallel to the surface 46 of the plating solution. This orientation provides an embodiment that is simpler and therefore provides less costly construction than the first embodiment, but requires more plating solution.

To demonstrate the viability of the plating apparatus and method for full size rocket engine combustion chamber components a five inch diameter by eight inch long cylinder fabricated from stainless steel sheet material was used. The two objectives of the demonstration were to first achieve an acceptable bond between the electro-deposited alloy and the part and second to achieve an acceptable bond at a rotation rate equivalent to a reasonable value for the full size hardware. These sub-scale tests successfully demonstrated that proper bond and composition can be achieved down to rotation rates of 2 rotations per minute (rpm).

Obviously, many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. A method for electroplating a metallic film on a rocket engine combustion chamber component, comprising the steps of:

a) providing a tank containing a plating solution and having an immersion depth less than the overall diameter of a combustion chamber component to accommodate only a portion of a surface to be plated on the component, b) rotating the surface of said combustion chamber component 'off-axis', such that a central axis of the component is angled with respect to a surface of the plating solution, said surface of the combustion chamber component to be electroplated is approximately parallel to the surface of the plating solution through the plating solution such that only the portion of the surface being plated is immersed within said plating solution at any time while being rotated; and, c) applying a current to an anode positioned in said tank proximate the surface of the combustion chamber component to be electroplated, wherein when said combustion chamber component is rotated, the immersed portion of the surface is deposited with metal from the plating solution.

2. The method of claim 1, wherein said step of rotating said combustion chamber component 'off-axis' provides the portion of the surface of the component immersed is 20 to 50 percent of the component surface area.

3. The method of claim 1, wherein said step of rotating the surface of said combustion chamber component comprises rotating, a combustion chamber jacket.

4. The method of claim 1, wherein said step of rotating the surface of said combustion chamber component comprises rotating a combustion chamber liner.

5. The method of claim 1, wherein said step of rotating the surface of said combustion chamber component 'off-axis ' provides the portion of the surface of the component immersed is 25 to 30 percent of the component surface area.

6. The method of claim 1 wherein the step of providing a tank includes positioning the anode in the tank having geometry which varies with a change in diameter of the combustion chamber component.

* * * * *